US009758335B2

(12) United States Patent
Taki

(10) Patent No.: US 9,758,335 B2
(45) Date of Patent: Sep. 12, 2017

(54) SHEET PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hiroyuki Taki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/093,318

(22) Filed: Apr. 7, 2016

(65) Prior Publication Data

US 2016/0347568 A1 Dec. 1, 2016

(30) Foreign Application Priority Data

May 25, 2015 (JP) ..... 2015-105860

(51) Int. Cl.

| | |
|---|---|
| ***B65H 31/26*** | (2006.01) |
| ***B65H 29/26*** | (2006.01) |
| ***B65H 29/44*** | (2006.01) |
| ***B65H 31/02*** | (2006.01) |
| ***B65H 31/30*** | (2006.01) |

(52) U.S. Cl.

CPC ..... *B65H 29/26* (2013.01); *B65H 29/44* (2013.01); *B65H 31/02* (2013.01); *B65H 31/3009* (2013.01); *B65H 2301/4212* (2013.01); *B65H 2301/4213* (2013.01); *B65H 2404/50* (2013.01); *B65H 2404/60* (2013.01); *B65H 2404/7414* (2013.01); *B65H 2701/18262* (2013.01); *B65H 2801/27* (2013.01)

(58) Field of Classification Search

CPC ..... B65H 29/20; B65H 29/22; B65H 29/26; B65H 29/38; B65H 29/40; B65H 29/44; B65H 31/24; B65H 31/26; B65H 2404/50; B65H 2404/60; B65H 2404/61; B65H 2404/63; B65H 2404/64; B65H 2404/656; B65H 2404/70; B65H 2404/74; B65H 2404/741; B65H 2404/7412; B65H 2404/7414; B65H 31/3009; B65H 2301/4212; B65H 2301/42131; B65H 2301/7412; B65H 2301/7414

USPC ..... 271/220

See application file for complete search history.

(56) References Cited

U.S. PATENT DOCUMENTS

| | | | | |
|---|---|---|---|---|
| 7,043,192 | B2 | 5/2006 | Terao et al. | |
| 7,215,922 | B2 | 5/2007 | Terao et al. | |
| 7,286,792 | B2 | 10/2007 | Terao et al. | |
| 7,530,565 | B2 * | 5/2009 | Terao | B42C 1/12 271/207 |

(Continued)

*Primary Examiner* — Prasad Gokhale

(74) *Attorney, Agent, or Firm* — Patterson & Sheridan, LLP

(57) ABSTRACT

According to an embodiment, a sheet processing apparatus includes a first tray, a second tray, a first member, and a second member. The first member presses a first portion of a sheet toward the second tray when the sheet is moved from the first tray to the second tray located below the first tray. The second member is interlocked with the first member, and when the sheet is moved from the first tray to the second tray, presses a second portion of the sheet toward the second tray, the second portion being located downstream of the first portion in a transport direction of the sheet to the first tray.

8 Claims, 13 Drawing Sheets

(56) References Cited

U.S. PATENT DOCUMENTS

| | | | | |
|---|---|---|---|---|
| 7,665,729 | B2 * | 2/2010 | Taki | B42C 1/125 270/58.08 |
| 7,866,647 | B2 * | 1/2011 | Terao | B65H 29/14 270/58.07 |
| 2005/0206065 | A1 * | 9/2005 | Herrmann | B65H 9/101 270/58.11 |
| 2007/0057435 | A1 * | 3/2007 | Terao | B42C 1/12 271/110 |
| 2007/0138728 | A1 * | 6/2007 | Terao | B65H 29/14 270/58.09 |
| 2008/0315492 | A1 * | 12/2008 | Taki | B42C 1/125 270/58.01 |
| 2008/0315495 | A1 * | 12/2008 | Taki | B42C 1/125 271/4.02 |
| 2009/0014941 | A1 * | 1/2009 | Taki | B42B 4/00 271/3.14 |
| 2013/0049280 | A1 * | 2/2013 | Soga | G03G 15/6552 271/3.14 |
| 2015/0035226 | A1 * | 2/2015 | Nishi | B65H 29/125 271/207 |

* cited by examiner

SHEET PROCESSING APPARATUS

CROSS-REFERENCE TO RELATED APPLICATION

This application is based upon and claims the benefit of priority from the prior Japanese Patent Application No. 2015-105860, filed on May 25, 2015, the entire contents of which are incorporated herein by reference.

FIELD

Embodiments described here generally relate to a sheet processing apparatus.

BACKGROUND

There is known a post-processing apparatus, which performs post-processing on sheets transported from an image-forming apparatus. The post-processing apparatus includes a processing tray and a standby tray. In the processing tray, post-processing is performed. The standby tray is provided above the processing tray. During the post-processing performed on sheets in the processing tray, the standby tray temporarily retains subsequent sheets. When the processing tray becomes empty, the standby tray drops the retained sheets toward the processing tray. In the post-processing apparatus, it is desirable that sheets be stably moved from the standby tray to the processing tray. When the post-processing apparatus is provided with a mechanism to stably move sheets from the standby tray to the processing tray, however, increase in size of the post-processing apparatus may be caused.

DETAILED DESCRIPTION

Figure 1:
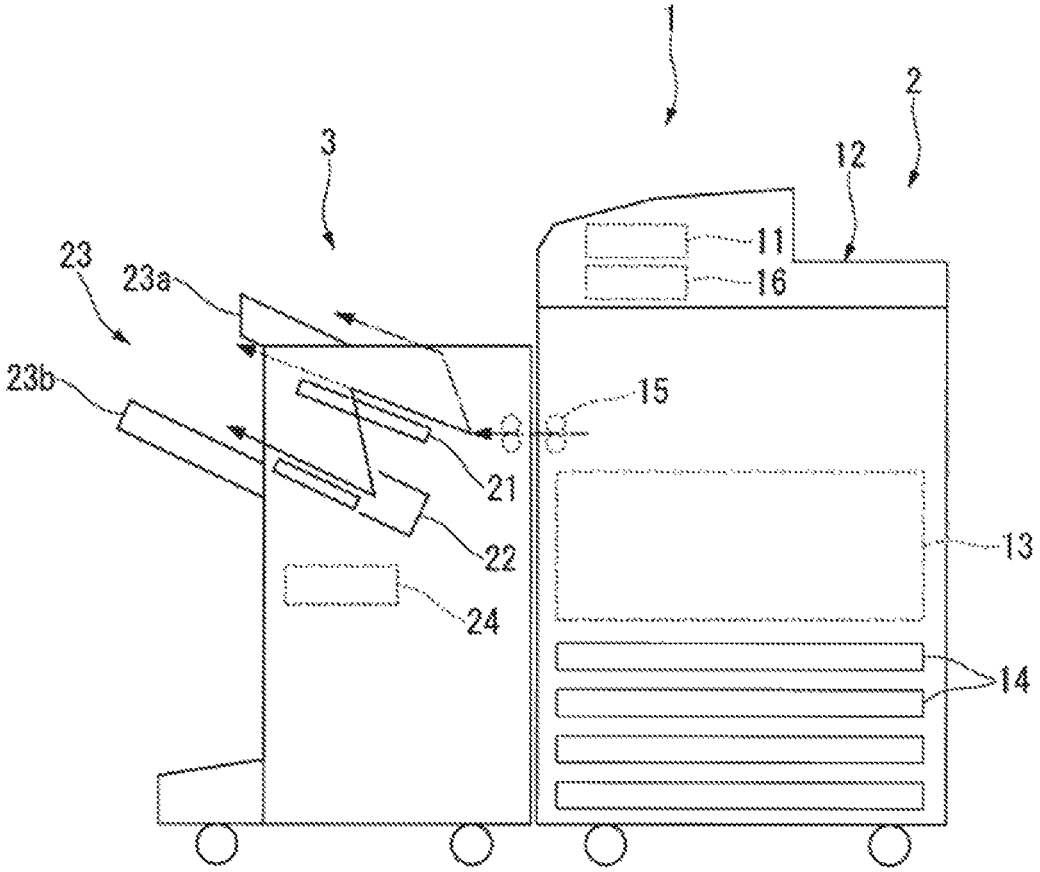
FIG. 1 is a front view showing an example of an overall configuration of an image-forming system according to a first embodiment.

According to one embodiment, a sheet processing apparatus includes a first tray, a second tray, a first member, a second member, and an interlocking unit. The first tray holds a transported sheet. The second tray is provided below the first tray and holds the sheet moved from the first tray. The first member presses a first portion of the sheet toward the second tray, when the sheet is moved from the first tray to the second tray. The second member presses a second portion of the sheet toward the second tray, when the sheet is moved from the first tray to the second tray. The second portion of the sheet is located downstream of the first portion of the sheet in a transport direction of the sheet to the first tray. The interlocking unit interlocks a pressing operation of the first member and a pressing operation of the second member.

Hereinafter, a sheet processing apparatus of each embodiment will be described with reference to the drawings. It should be noted that in the following description, configurations having an identical or similar function are denoted by an identical reference symbol, and overlapping description thereof may be omitted.

(First Embodiment)

A sheet processing apparatus of a first embodiment will be described with reference to FIGS. 1 to 9. First, FIGS. 1 and 2 each show an example of an overall configuration of an image-forming system 1. The image-forming system 1 includes an image-forming apparatus 2 and a post-processing apparatus 3. The image-forming apparatus 2 forms an image on sheet-like media such as paper (hereinafter, described as "sheets"). The post-processing apparatus 3 performs post-processing on the sheets transported from the image-forming apparatus 2. The post-processing apparatus 3 is an example of a "sheet processing apparatus".

The image-forming apparatus 2 includes a control panel 11, a scanner 12, a printer 13, a paper feed unit 14, a paper discharge unit 15, and an image-forming control unit 16.

The control panel 11 includes various keys that receive user's operations. For example, the control panel 11 receives an input on a type of post-processing performed on sheets. The control panel 11 transmits information on the input type of post-processing to the post-processing apparatus 3.

The scanner 12 includes a read section that reads image information of an object to be duplicated. The scanner 12 transmits the read image information to the printer 13. The printer 13 forms an output image (hereinafter, described as "toner image") by a developer such as toner on the basis of the image information transmitted from the scanner 12 or an external device. The printer 13 transfers the toner image onto a surface of a sheet. The printer 13 applies heat and pressure to the toner image transferred onto the sheet, to fix the toner image onto the sheet.

The paper feed unit 14 supplies sheets to the printer 13 one by one at a timing at which the printer 13 forms a toner image. The paper discharge unit 15 transports the sheets, which are discharged from the printer 13, to the post-processing apparatus 3.

The image-forming control unit 16 controls an overall operation of the image-forming apparatus 2. In other words, the image-forming control unit 16 controls the control panel 11, the scanner 12, the printer 13, the paper feed unit 14, and the paper discharge unit 15. The image-forming control unit 16 is a control circuit including a CPU (Central Processing Unit), a ROM (Read Only Memory), and a RAM (Random Access Memory), for example.

Next, the post-processing apparatus (sheet processing apparatus) 3 will be described. First, an overall configuration of the post-processing apparatus 3 will be described. As shown in FIG. 1, the post-processing apparatus 3 is disposed adjacently to the image-forming apparatus 2. The post-processing apparatus 3 executes post-processing on sheets transported from the image-forming apparatus 2, the post-processing being specified through the control panel 11. The post-processing includes stapling processing or sorting processing, for example. The post-processing apparatus 3 includes a standby unit 21, a processing unit 22, a discharge unit 23, and a post-processing control unit 24.

The standby unit 21 temporarily retains (buffers) sheets S (see FIG. 3) transported from the image-forming apparatus 2. For example, the standby unit 21 keeps a plurality of subsequent sheets S waiting during post-processing performed on preceding sheets S in the processing unit 22. The standby unit 21 is provided above the processing unit 22. When the processing unit 22 becomes empty, the standby unit 21 drops the retained sheets S toward the processing unit 22.

The processing unit 22 performs post-processing on the sheets S. For example, the processing unit 22 aligns the plurality of sheets S. The processing unit 22 performs stapling processing on the plurality of aligned sheets S. As a result, the plurality of sheets S are bound together. The processing unit 22 discharges the sheets S, which are subjected to the post-processing, to the discharge unit 23.

The discharge unit 23 includes a fixed tray 23*a* and a movable tray 23*b*. The fixed tray 23*a* is provided to an upper portion of the post-processing apparatus 3. The movable tray 23*b* is provided to a side portion of the post-processing apparatus 3. The fixed tray 23*a* and the movable tray 23*b* hold the sheets S that are subjected to the sorting processing and then discharged, for example.

Figure 2:
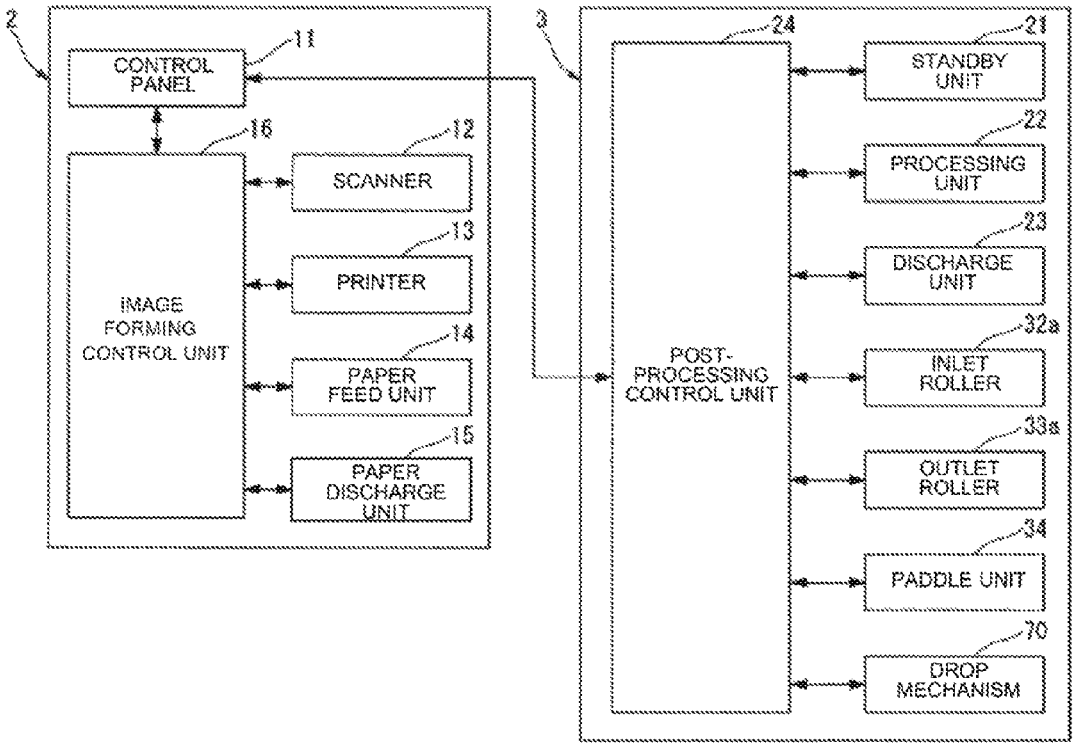
FIG. 2 is a block diagram showing the example of the overall configuration of the image-forming system according to the first embodiment.

The post-processing control unit 24 controls an overall operation of the post-processing apparatus 3. In other words, the post-processing control unit 24 controls the standby unit 21, the processing unit 22, and the discharge unit 23. Further, as shown in FIG. 2, the post-processing control unit 24 controls an inlet roller 32*a*, an outlet roller 33*a*, a paddle unit 34, and a drop mechanism 70, which will be described later. The post-processing control unit 24 is a control circuit including a CPU, a ROM, and a RAM, for example.

Next, configurations of the sections of the post-processing apparatus 3 will be described in detail. It should be noted that in description on the following embodiments, a "sheet transport direction" means a transport direction D of the sheets S of the standby unit 21 to a standby tray 41 (entry direction of the sheets S to the standby tray 41). Further, in the description on the following embodiments, an "upstream side" and a "downstream side" mean an upstream side and a downstream side in the sheet transport direction D, respectively. Further, in the description on the following embodiments, a "front end" and a "rear end" mean an "end of the downstream side" and an "end of the upstream side" in the sheet transport direction D, respectively. Additionally, in the description on the following embodiments, a direction that is substantially parallel to an upper surface (transport surface) 45*b* of the standby tray 41 and is substantially orthogonal to the sheet transport direction D is described as a sheet width direction W.

Figure 3:
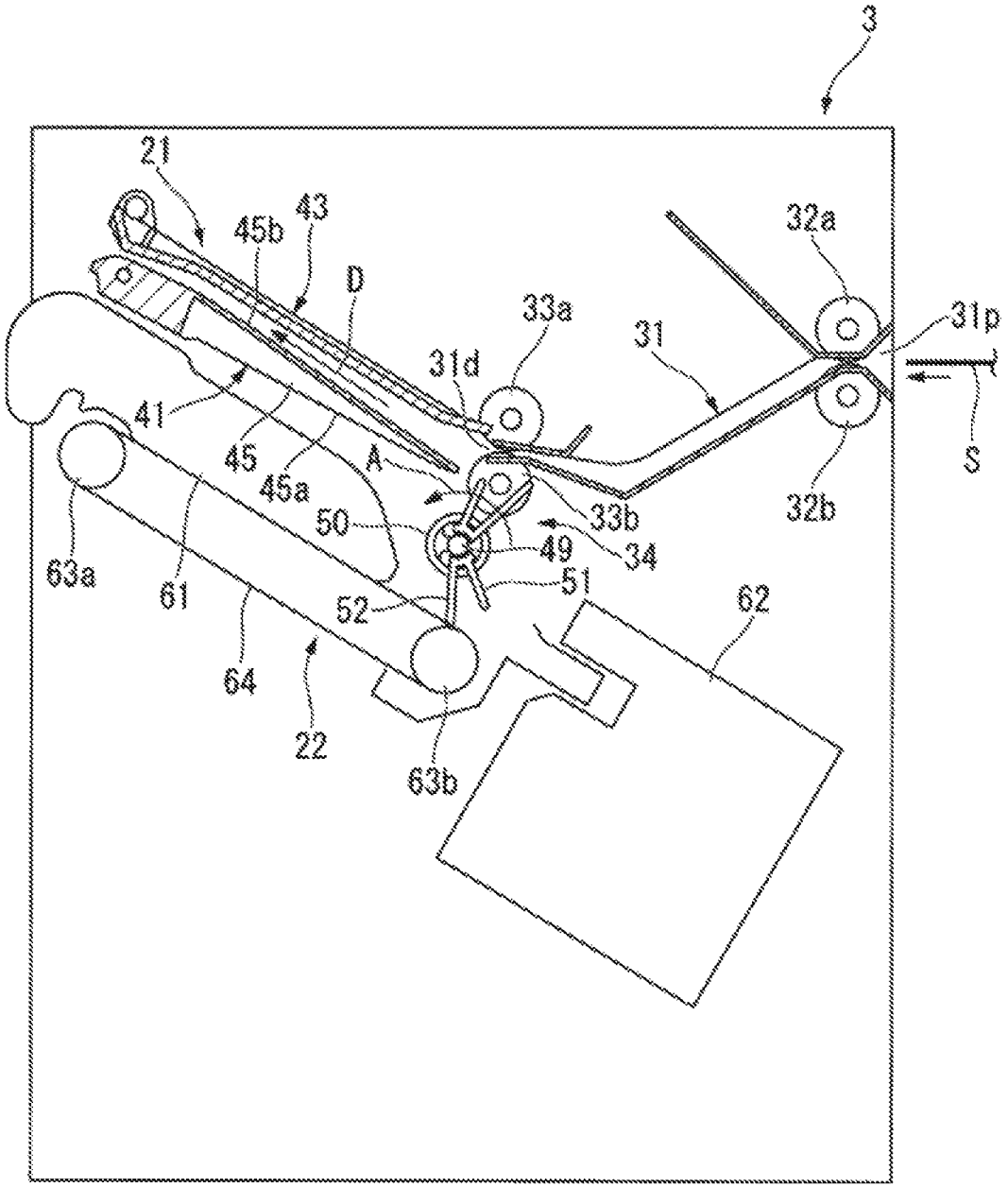
FIG. 3 is a cross-sectional view showing a configuration example of a post-processing apparatus according to the first embodiment.

FIG. 3 schematically shows a configuration of the post-processing apparatus 3. As shown in FIG. 3, the post-processing apparatus 3 includes a transport path 31 for the sheets S, a pair of inlet rollers 32*a* and 32*b*, a pair of outlet rollers 33*a* and 33*b*, the standby unit 21, the paddle unit 34, and the processing unit 22.

The transport path 31 is provided inside the post-processing apparatus 3. The transport path 31 includes a sheet supply port 31*p* and a sheet discharge port 31*d*. The sheet supply port 31*p* faces the image-forming apparatus 2. The sheets S are supplied from the image-forming apparatus 2 to the sheet supply port 31*p*. Meanwhile, the sheet discharge port 31*d* is located near the standby unit 21. The sheets S that have passed through the transport path 31 are discharged from the sheet discharge port 31*d* to the standby unit 21.

The inlet rollers 32*a* and 32*b* are provided near the sheet supply port 31*p*. The inlet rollers 32*a* and 32*b* transport the sheets S, which have been supplied to the sheet supply port 31*p*, toward the downstream side of the transport path 31. For example, the inlet rollers 32*a* and 32*b* transport the sheets S, which have been supplied to the sheet supply port 31*p*, to the outlet rollers 33*a* and 33*b*.

The outlet rollers 33*a* and 33*b* are provided near the sheet discharge port 31*d*. The outlet rollers 33*a* and 33*b* receive the sheets S transported by the inlet rollers 32*a* and 32*b*. The outlet rollers 33*a* and 33*b* transport the sheets S from the sheet discharge port 31*d* to the standby unit 21.

Next, the standby unit 21 will be described. The standby unit 21 includes a standby tray (buffer tray) 41, an opening and closing drive unit 42 (see FIG. 4), and a transport guide 43.

The standby tray 41 is an example of a "first tray". The rear end of the standby tray 41 is located near the outlet rollers 33*a* and 33*b*. The rear end of the standby tray 41 is located to be slightly lower than the sheet discharge port 31*d* of the transport path 31. The standby tray 41 is tilted with respect to a horizontal direction so as to gradually increase in height toward the downstream side of the sheet transport direction D. During post-processing performed on preceding sheets in the processing unit 22, the standby tray 41 holds a plurality of subsequent sheets S in an overlapping manner in order to keep the plurality of subsequent sheets S waiting.

The standby tray 41 includes a bottom wall 45 and side walls (not shown). The bottom wall 45 includes a lower surface 45*a* and an upper surface (transport surface) 45*b*. The bottom wall 45 supports the sheets S from below. The side walls support side portions in the sheet width direction W of the sheets S.

Figure 4:
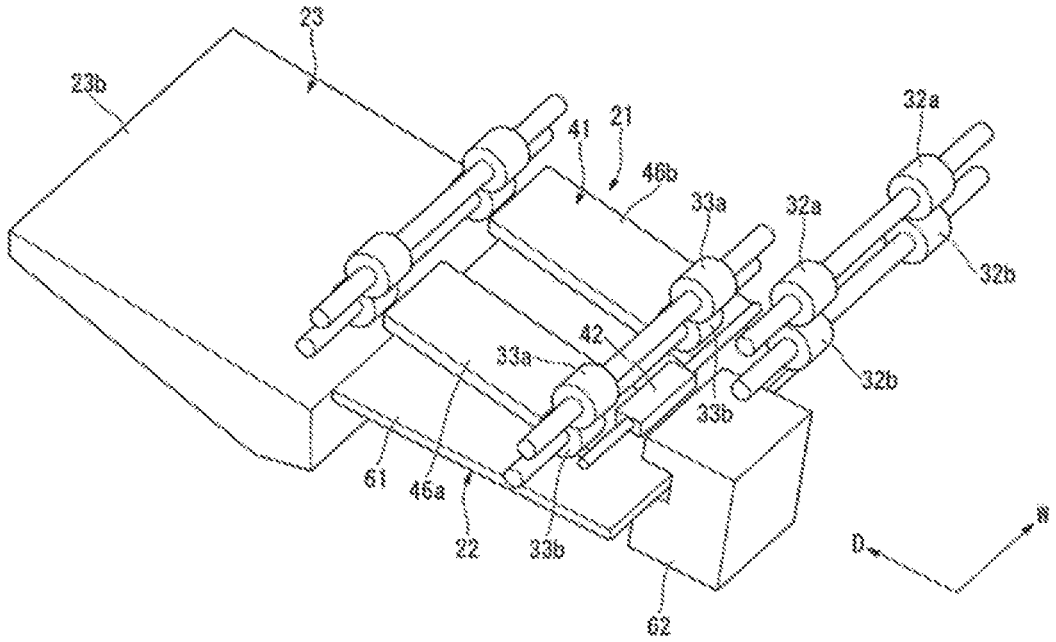
FIG. 4 is a perspective view showing a standby unit and a processing unit of the post-processing apparatus according to the first embodiment.

FIG. 4 schematically shows the standby tray 41. As shown in FIG. 4, the standby tray 41 includes a first tray member 46*a* and a second tray member 46*b*. The first tray member 46*a* and the second tray member 46*b* are separated from each other in the sheet width direction W. The first tray member 46*a* and the second tray member 46*b* are movable in a mutually approaching direction and a mutually separating direction.

The opening and closing drive unit 42 can drive the first tray member 46*a* and the second tray member 46*b* in the mutually approaching direction and the mutually separating direction. In the case where the sheets S wait in the standby tray 41, the opening and closing drive unit 42 drives the first tray member 46*a* and the second tray member 46*b* so as to approach each other. As a result, the sheets S are supported by the first tray member 46*a* and the second tray member 46*b*. Meanwhile, in the case where the sheets S are moved from the standby tray 41 toward a processing tray 61 of the processing unit 22, the opening and closing drive unit 42 drives the first tray member 46*a* and the second tray member 46*b* so as to separate from each other. As a result, the sheets S supported by the standby tray 41 drop toward the processing tray 61 from a gap between the first tray member 46*a* and the second tray member 46*b*. As a result, the sheets S are moved from the standby tray 41 to the processing tray 61.

The transport guide 43 (assist guide) is an example of a "first member (first pressing member, first biasing member)".

As shown in FIG. 3, the transport guide 43 is provided above the standby tray 41. For example, the transport guide 43 has a length substantially equal to or larger than the half length of the standby tray 41 in the sheet transport direction D. In this embodiment, the transport guide 43 has a length substantially the same as the standby tray 41 in the sheet transport direction D. The transport guide 43 is a plate-like member provided above the standby tray 41 (see FIG. 6). The sheets S discharged from the outlet rollers 33*a* and 33*b* enter a gap between the transport guide 43 and the standby tray 41. The sheets S that have entered the standby unit 21 are guided by the transport guide 43 and the standby tray 41 and proceed toward the depth of the standby unit 21.

Figure 7:
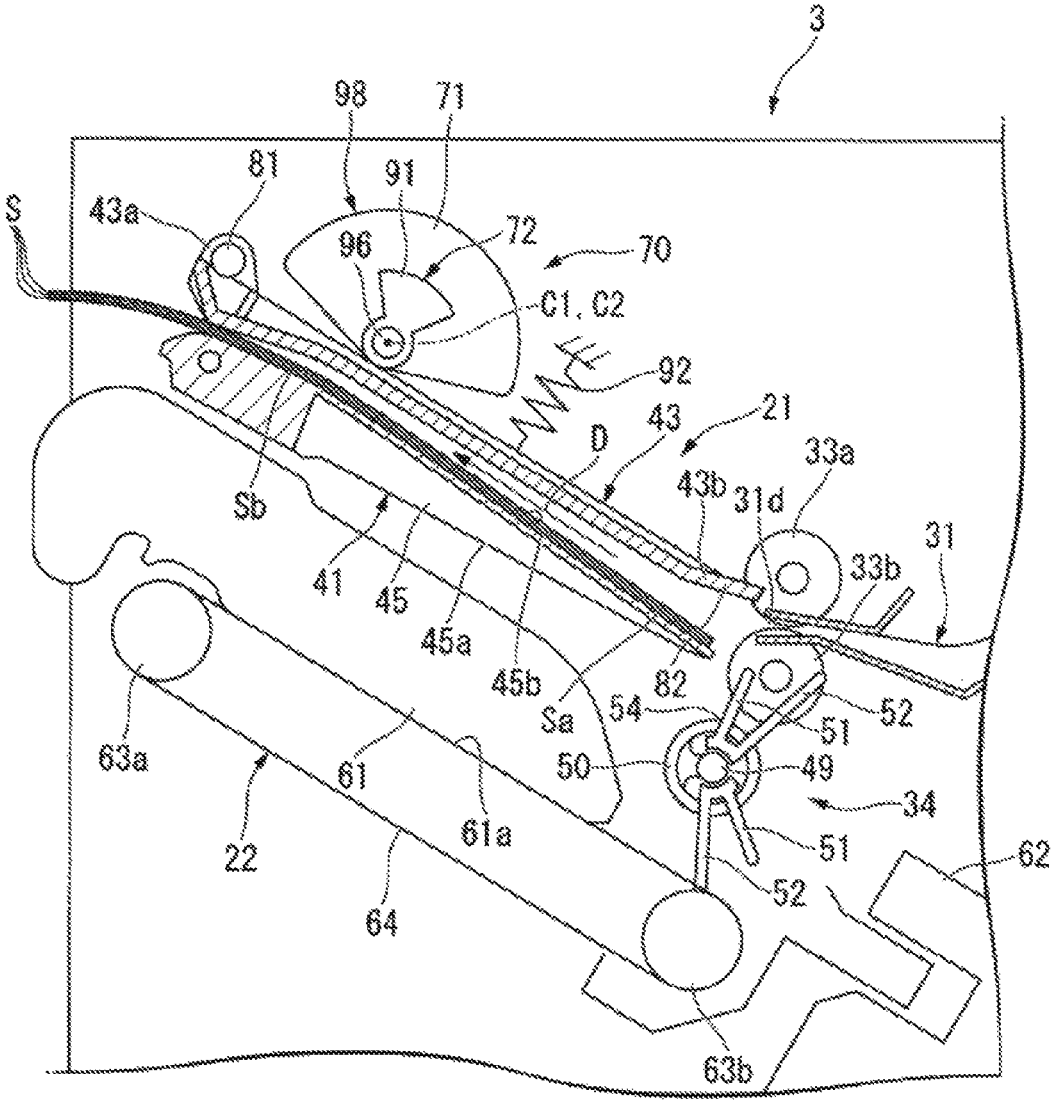
FIG. 7 is a cross-sectional view showing an operation of the post-processing apparatus according to the first embodiment.
Figure 8:
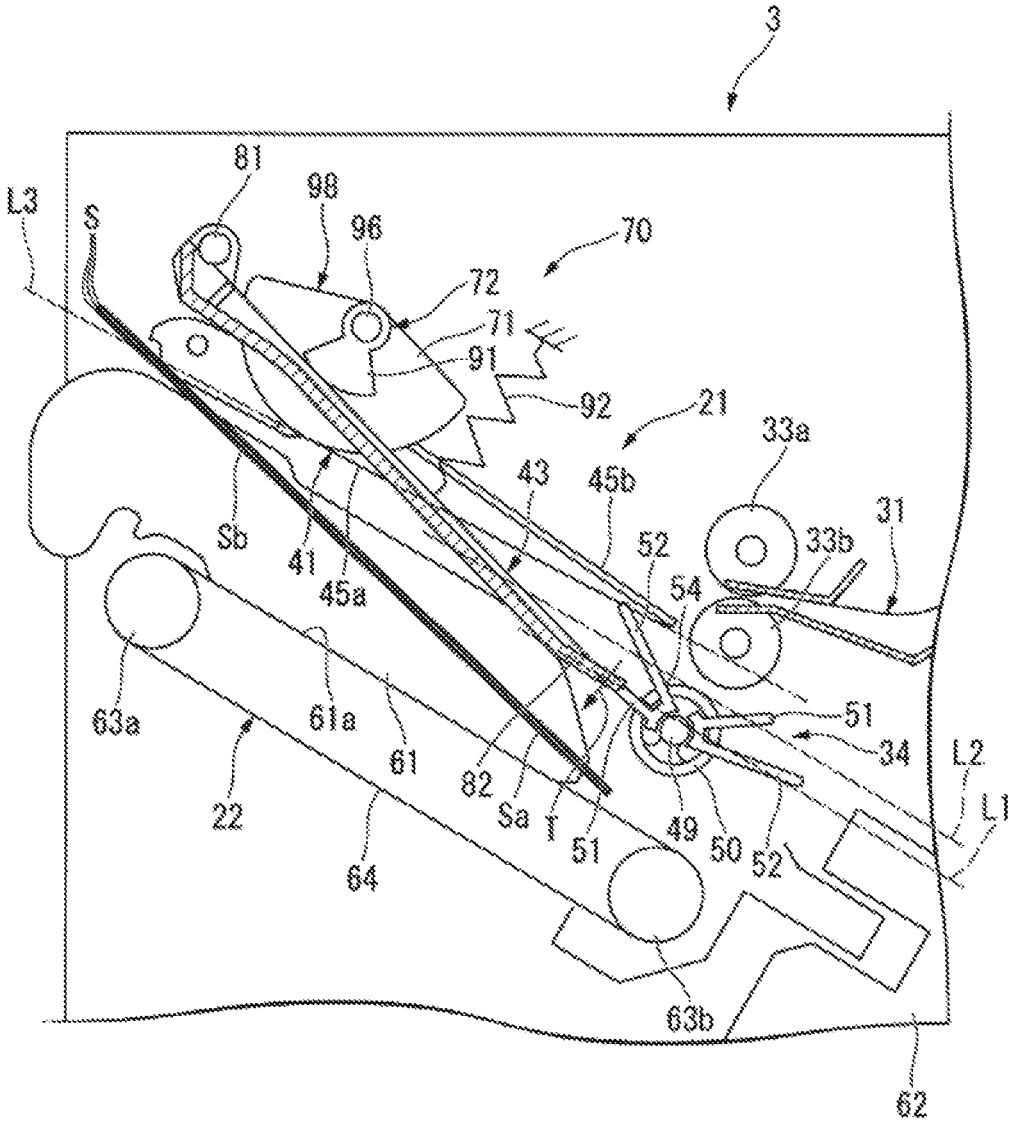
FIG. 8 is a cross-sectional view showing an operation of the post-processing apparatus according to the first embodiment.

The transport guide 43 of this embodiment is movable between a standby position (see FIG. 7) and a protruding position (see FIG. 8). In the standby position, the whole of the transport guide 43 is located above the standby tray and faces the standby tray 41. Additionally, in the standby position, the transport guide 43 guides the transported sheets S to the standby tray 41. In other words, the standby position is a guide position at which the transport guide 43 guides the sheets S. In the protruding position, at least a part of the transport guide 43 protrudes downward below the lower surface 45*a* of the standby tray 41. In the case where the sheets S are moved from the standby tray 41 toward the processing tray 61, the transport guide 43 can press the sheets S toward the processing tray 61 by moving from the standby position to the protruding position. In other words, the protruding position is a pressing position at which the transport guide 43 presses the sheets S. It should be noted that such a function of the transport guide 43 will be described later in detail.

Next, the paddle unit 34 will be described. As described in FIG. 3, the paddle unit 34 is provided between the standby tray 41 and the processing tray 61. In the case where the sheets S are moved from the standby tray 41 to the processing tray 61, the paddle unit 34 hits the sheets S toward the processing tray 61. Additionally, the paddle unit 34 moves the sheets S, which have dropped on the processing tray 61, toward a stapler 62 that will be described later. Specifically, the paddle unit 34 includes a rotating shaft 49, a rotating body 50, a plurality of first paddles 51, and a plurality of second paddles 52.

The rotating shaft 49 is the center of rotation of the rotating body 50 of the paddle unit 34. The rotating shaft 49 extends in the sheet width direction W. The paddle unit 34 is rotated about the rotating shaft 49 in a direction of an arrow A in FIG. 3. The rotating body 50 is cylindrically formed. The rotating body 50 is rotated about the rotating shaft 49. The rotating body 50 is provided with the first paddles 51 and the second paddles 52.

The first paddles 51 and the second paddles 52 protrude from the rotating body 50 in a radial direction of the rotating body 50. The first paddles 51 and the second paddles 52 are each formed of an elastic member such as rubber. The first paddles 51 are rotated at a timing at which the sheets S are moved from the standby tray 41 toward the processing tray 61, to hit the sheets S toward the processing tray 61. As a result, also in the case where the sheets S stick to the transport guide 43, the sheets S are reliably removed from the transport guide 43.

The second paddles 52 are located behind the respective first paddles 51 in the rotation direction of the rotating body 50 of the paddle unit 34. The length of each second paddle 52 is larger than that of each first paddle 51 in the radial direction of the rotating body 50. The second paddles 52 are rotated to come into contact with the upper surface of a sheet S, which is located in an uppermost position in the plurality of sheets S that have dropped on the processing tray 61. The second paddles 52 are further rotated in the state of being in contact with the upper surface of the sheet S, and thus moves the sheets S toward the stapler 62.

Next, the processing unit 22 will be described. The processing unit 22 includes the processing tray 61, the stapler 62, transport rollers 63*a* and 63*b*, and a transport belt 64.

The processing tray 61 is an example of a "second tray". The processing tray 61 is provided below the standby tray 41.

The processing tray 61 is tilted with respect to the horizontal direction so as to gradually increase in height toward the downstream side of the sheet transport direction D.

For example, the processing tray 61 is tilted substantially parallel to the standby tray 41. The processing tray 61 aligns the plurality of sheets S moved from the standby tray 41 in the sheet width direction W and the sheet transport direction D by an alignment plate or the like.

The stapler 62 is provided to an end of the processing tray 61. The stapler 62 performs stapling (binding) processing on a batch of a predetermined number of sheets S located on the processing tray 61.

The transport rollers 63*a* and 63*b* are disposed with a predetermined interval therebetween in the sheet transport direction D. The transport belt 64 is stretched over the transport rollers 63*a* and 63*b*. The transport belt 64 is rotated in synchronization with the transport rollers 63*a* and 63*b*. The transport belt 64 transports the sheets S between the stapler 62 and the discharge unit 23.

Figure 5:
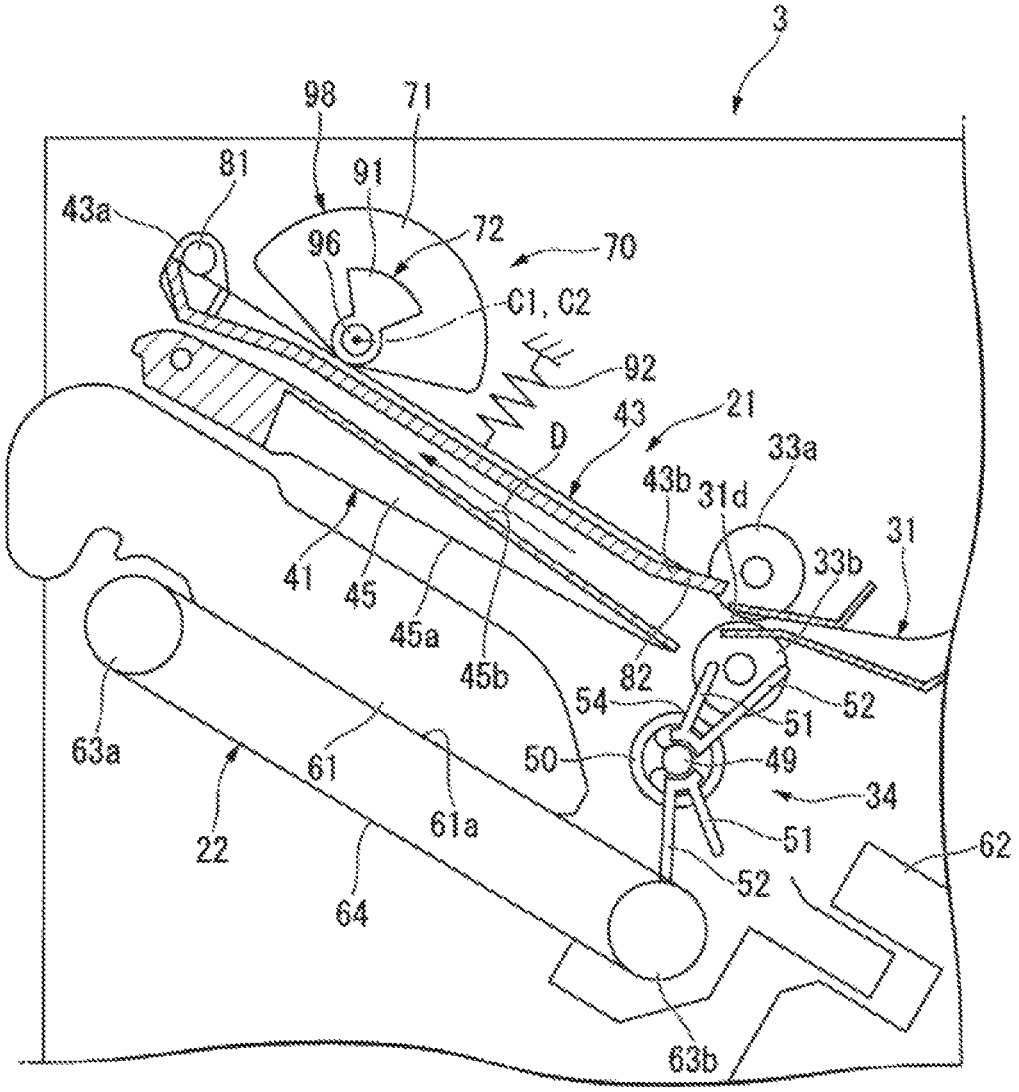
FIG. 5 is a cross-sectional view showing the standby unit and the processing unit of the post-processing apparatus according to the first embodiment.

Next, the drop mechanism 70 that drops the sheets S will be described in details. FIG. 5 shows the drop mechanism 70 in an enlarged manner. As shown in FIG. 5, the post-processing apparatus 3 includes the drop mechanism 70 that stably drops the sheets S from the standby tray 41 toward the processing tray 61. Specifically, the drop mechanism 70 includes, in addition to the transport guide 43 described above, a pressing member 71, an interlocking unit 72, and a drive source 73 (see FIG. 6).

First, the transport guide 43 will be described. As described above, the transport guide 43 is movable between the standby position and the protruding position. In the case where the sheets S are moved from the standby tray 41 toward the processing tray 61, the transport guide 43 moves from the standby position to the protruding position. Thus, the transport guide 43 can press a first portion Sa of the sheets S (see FIG. 7) toward the processing tray 61. The first portion Sa of the sheets S is a portion on the upstream side relative to the center portion of the sheets S in the sheet transport direction D. For example, the first portion Sa of the sheets S is the rear end of the sheets S.

Specifically, as shown in FIG. 5, the transport guide 43 includes a first end 43*a* and a second end 43*b* in the sheet transport direction D. The first end 43*a* is an end of the downstream side in the sheet transport direction D. The first end 43*a* includes a turning shaft 81 that is the center of turn of the transport guide 43. For example, the turning shaft 81 is located on the downstream side relative to the pressing member 71. Meanwhile, the second end 43*b* is an end of the upstream side in the sheet transport direction D. The second end 43*b* includes a pressing portion 82 that comes into contact with the sheets S.

Figure 6:
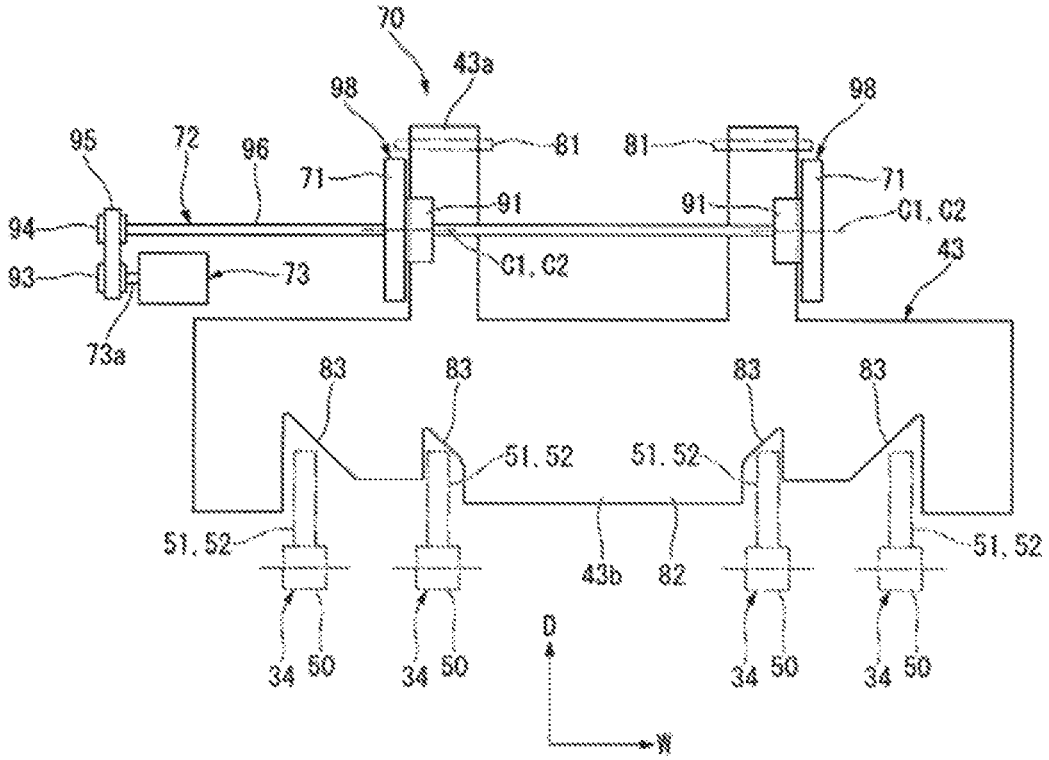
FIG. 6 is a plan view showing a transport guide and an interlocking unit of the post-processing apparatus according to the first embodiment.

FIG. 6 is a top view of the transport guide 43. The width of the second end 43*b* in the sheet width direction W is larger than the width of the first end 43*a* in the sheet width direction W. For example, the second end 43*b* has a width that is sufficient to cover the rear end of the sheets S having various standards (for example, postcard size, B5 size, and A4 size).

As shown in FIG. 6, the second end 43*b* is provided with a plurality of notches 83. The notches 83 extend from a rear edge of the second end 43*b* in the sheet transport direction D. The notches 83 are formed at positions corresponding to the first and second paddles 51 and 52 of the paddle unit 34. The first and second paddles 51 and 52 of the paddle unit 34 pass through the notches 83 of the second end 43*b*, and thus can hit the sheets S without coming into contact with the transport guide 43. In other words, the transport guide 43 of this embodiment extends to the upstream side of the sheet transport direction D beyond at least a part of the rotation trajectories of the first and second paddles 51 and 52. Thus, the transport guide 43 of this embodiment can press the rear edge of the sheets S or a portion near the rear edge toward the processing tray 61. The transport guide 43 presses the rear edge of the sheets S or a portion near the rear edge. Thus, the rear end of the sheets S, which is apt to curl, can be stably moved downward.

Further, FIG. 8 shows an example of the protruding position of the transport guide 43. As shown in FIG. 8, the pressing portion 82 of the transport guide 43 descends to substantially the same position as the rotating shaft 49 of the paddle unit 34 in a direction substantially parallel to an upper surface 61*a* of the processing tray 61, for example. In other words, in the protruding position, the pressing portion 82 of the transport guide 43 is aligned with at least a part of the rotating shaft 49 of the paddle unit 34 in the direction substantially parallel to the upper surface 61*a* of the processing tray 61 (see a virtual line L1 in FIG. 8).

From a different perspective, the pressing portion 82 of the transport guide 43 descends below a base 54 of at least one of the paddles 51 and 52 in the direction substantially parallel to the upper surface 61*a* of the processing tray 61.

It should be noted that the base 54 of each of the paddles 51 and 52 is a boundary portion between each of the paddles 51 and 52 and the rotating body 50. In other words, the pressing portion 82 of the transport guide 43 descends below an upper end of the rotating body 50 (see a virtual line L2 in FIG. 8) in the direction substantially parallel to the upper surface 61*a* of the processing tray 61.

According to such a configuration, the sheets S can be stably pressed by the transport guide 43 up to a position near the processing tray 61. Further, according to the configuration described above, a contact direction T of the first and second paddles 51 and 52 with respect to the sheets S is unlikely to be oriented in the opposite direction to the stapler 62. In other words, it is possible to prevent the paddles 51 and 52 from strongly pressing the sheets S toward the opposite direction to the stapler 62. This makes it easier to efficiently transport the sheets S, which have dropped on the processing tray 61, toward the stapler 62.

Next, the pressing member 71 will be described. The pressing member 71 is an example of a "second member (second pressing member, second biasing member)". As shown in FIG. 5, the pressing member 71 is provided above the standby tray 41. The pressing member 71 is movable between the standby position (see FIG. 7) and the protruding position (see FIG. 8). In the standby position, the whole of the pressing member 71 is located above the standby tray 41. In the protruding position, the pressing member 71 protrudes to substantially the same position as at least the lower surface 45*a* of the standby tray 41. It should be noted that the description "the pressing member 71 protrudes to substantially the same position as the lower surface 45*a* of the standby tray 41" means that a lower end of the pressing member 71 is aligned with the lower surface 45*a* of the standby tray 41 in a direction substantially parallel to the lower surface 45*a* of the standby tray 41 (see a virtual line L3 in FIG. 8). In the case where the sheets S are moved from the standby tray 41 toward the processing tray 61, the pressing member 71 can press the sheets S toward the processing tray 61 by moving from the standby position to the protruding position.

In this embodiment, the pressing member 71 is located between the turning shaft 81 and the pressing portion 82 of the transport guide 43 in the sheet transport direction D. As shown in FIG. 8, in the case where the sheets S are moved from the standby tray 41 toward the processing tray 61, the pressing member 71 can press the sheets S toward the processing tray 61 by protruding downward below at least a part of the transport guide 43.

Specifically, the pressing member 71 can press a second portion Sb of the sheets S. The second portion Sb of the sheets S is located downstream of the first portion Sa of the sheets S in the sheet transport direction D. The second portion Sb of the sheets S is a portion on the downstream side relative to the center portion of the sheets S in the sheet transport direction D. For example, the second portion Sb of the sheets S may be the front end of the sheets S. In other words, according to this embodiment, in the case where the sheets S are moved from the standby tray 41 toward the processing tray 61, a plurality of portions (first portion Sa and second portion Sb) of the sheets S in the sheet transport direction D are pressed toward the processing tray 61.

As shown in FIG. 5, for example, the pressing member 71 is a first cam (large cam). The pressing member 71 has the center of rotation C1 located above the standby tray 41. The pressing member 71 is a cam having an outer circumferential surface that is eccentric relative to the center of rotation C1. For example, the pressing member 71 is a fan-like cam that is smaller than a semicircle. The pressing member 71 moves between the standby position and the protruding position by being rotated about the center of rotation C1. As shown in FIG. 6, the pressing member 71 is provided so as not to overlap with the transport guide 43 in a vertical direction. As a result, the pressing member 71 can protrude downward below the transport guide 43 without disturbance of the transport guide 43. The pressing member 71 is provided at a plurality of spots (e.g., two spots) in the sheet width direction W.

Next, the interlocking unit 72 will be described. The interlocking unit 72 interlocks the transport guide 43 and the pressing member 71. Specifically, as shown in FIGS. 5 and 6, the interlocking unit 72 includes a drive member 91, a spring 92, a drive pulley 93, a driven pulley 94, a drive belt 95, and a coupling shaft 96.

The drive member 91 is a member to move the transport guide 43 from the standby position to the protruding position. As shown in FIG. 5, for example, the drive member 91 is a second cam (small cam). The drive member 91 has the center of rotation C2 located above the standby tray 41. The drive member 91 is a cam having an outer circumferential surface that is eccentric relative to the center of rotation C2. For example, the drive member 91 is a fan-like cam that is smaller than a semicircle. The drive member 91 comes into contact with the upper surface of the transport guide 43 by being rotated above the center of rotation C2. The drive member 91 presses the transport guide 43 downward by being further rotated in a state where the drive member 91 is in contact with the upper surface of the transport guide 43. As a result, the drive member 91 moves the transport guide 43 from the standby position toward the protruding position.

As shown in FIG. 6, the drive member 91 is provided so as to overlap with the transport guide 43 in the vertical direction. The drive member 91 is provided at a plurality of spots (e.g., two spots) in the sheet width direction W. Further, the drive member 91 is provided adjacently to the pressing member 71. For example, the center of rotation C2 of the drive member 91 and the center of rotation C1 of the pressing member 71 are coaxially provided. Both the drive member 91 and the pressing member 71 are fixed to the coupling shaft 96 that will be described later. Thus, the drive member 91 and the pressing member 71 are integrally rotated. It should be noted that hereinafter, for the purpose of description, the drive member 91 and the pressing member 71 are integrally considered and described as a "rotary member 98".

As shown in FIG. 5, the spring 92 is provided on the upper side of the transport guide 43. The spring 92 biases the transport guide 43 upward. Thus, the transport guide 43 that has moved to the protruding position returns to the standby position by the biasing force of the spring 92, when depression by the drive member 91 is released.

As shown in FIG. 6, the drive pulley 93 is coupled to a drive shaft 73*a* of the drive source 73. For example, the drive source 73 is a motor. The driven pulley 94 is provided aside of the drive pulley 93. The drive belt 95 is stretched over the drive pulley 93 and the driven pulley 94. A first end of the coupling shaft 96 is coupled to the driven pulley 94. A second end of the coupling shaft 96 is coupled to the pressing member 71 and the drive member 91. Further, the coupling shaft 96 is coupled to the pair of rotary members 98. As a result, when the drive shaft 73*a* of the drive source 73 rotates, the rotary members 98 rotate. When the rotary members 98 rotate, the transport guide 43 and the pressing members 71 move toward the processing tray 61.

Next, an operation flow of the post-processing apparatus 3 will be described. FIG. 7 shows a case where the sheets S enter the standby tray 41. In this case, the transport guide 43 and the pressing members 71 are located above the standby tray 41.

FIG. 8 shows a case where the sheets S are moved from the standby tray 41 toward the processing tray 61. In this case, the post-processing control unit 24 rotates the drive shaft 73*a* of the drive source 73. When the drive shaft 73*a* of the drive source 73 rotates, along with the rotation of the drive shaft 73*a*, the drive members 91 and the pressing members 71 rotate. When the drive members 91 (small cams) rotate, the transport guide 43 is pressed downward. The transport guide 43 pressed downward rotates about the turning shaft 81, and thus presses the first portion Sa of the sheets S toward the processing tray 61. Further, when the pressing members 71 (large cams) rotate, the pressing members 71 protrude downward below at least a part of the transport guide 43. As a result, the pressing members 71 press the second portion Sb of the sheets S toward the processing tray 61.

Here, the sheets S are held in a state of being placed on the standby tray 41 obliquely tilted. Thus, the second portion Sb of the sheets S is located at a higher position than the first portion Sa. Thus, if the second portion Sb of the sheets S starts to drop earlier than the first portion Sa, the drop balance of the sheets S may be disturbed. In this regard, in this embodiment, a timing at which the pressing members 71 come into contact with the second portion Sb of the sheets S is adjusted to get behind a timing at which the transport guide 43 comes into contact with the first portion Sa of the sheets S. Thus, the first portion Sa of the sheets S starts to drop reliably earlier than the second portion Sb of the sheets S. As a result, the drop of the sheets S is liable to be stable.

Figure 9:
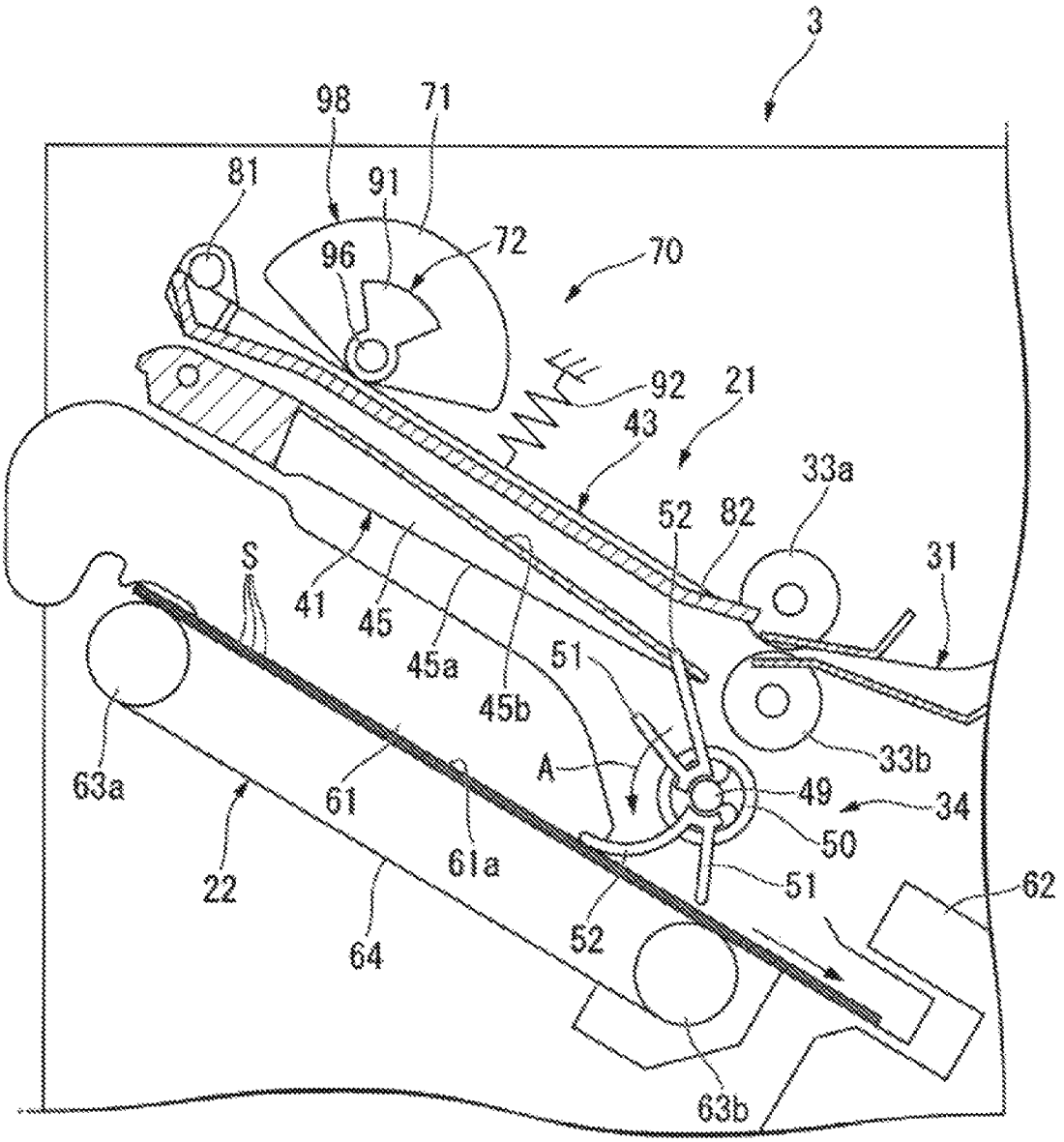
FIG. 9 is a cross-sectional view showing an operation of the post-processing apparatus according to the first embodiment.

FIG. 9 shows a case where the sheets S on the processing tray 61 are transported toward the stapler 62. As shown in FIG. 9, in the case where the sheets S drop toward the processing tray 61, the rotating body 50 of the paddle unit 34 is rotated. As a result, for example, the sheets S on the processing tray 61 are transported toward the stapler 62 by the second paddles 52. Further, in this case, the transport rollers 63*a* and 63*b* and the transport belt 64 of the processing tray 61 are driven to transport the sheets S toward the stapler 62. As a result, the sheets S on the processing tray 61 are transported toward the stapler 62.

According to the post-processing apparatus 3 having the configuration as described above, the sheets S can be stably moved, and downsizing can also be achieved. In general, in the post-processing apparatus, it is desirable to stably move sheets from the standby tray to the processing tray. Thus, in the case where the sheets are moved from the standby tray toward the processing tray, it is desirable for the post-processing apparatus to press a plurality of portions, such as a front end and a rear end, of the sheets in the sheet transport direction toward the processing tray. However, if a drive source of a mechanism to press the front end of the sheets and a drive source of a mechanism to press the rear end of the sheets are provided separately, the enlargement of the post-processing apparatus may be caused.

Meanwhile, the post-processing apparatus 3 of this embodiment includes the standby tray 41, the processing tray 61, the transport guide 43, the pressing members 71, and the interlocking unit 72. The processing tray 61 is provided below the standby tray 41. In the case where the sheets S are moved from the standby tray 41 toward the processing tray 61, the transport guide 43 can press the first portion Sa of the sheets S toward the processing tray 61. In the case where the sheets S are moved from the standby tray 41 toward the processing tray 61, the pressing members 71 can press the second portion Sb of the sheets S toward the processing tray 61, the second portion Sb of the sheets S being located downstream of the first portion Sa of the sheets S in the sheet transport direction D. The interlocking unit 72 interlocks the transport guide 43 and the pressing members 71.

According to such a configuration, in the case where the sheets S are moved from the standby tray 41 toward the processing tray 61, a plurality of portions Sa and Sb of the sheets S in the sheet transport direction D can be pressed toward the processing tray 61 by the transport guide 43 and the pressing members 71. Thus, the sheets S are liable to be moved more stably from the standby tray 41 toward the processing tray 61. Further, according to the configuration described above, the transport guide 43 and the pressing members 71 are interlocked to move by the interlocking unit 72. Thus, one drive source 73 can drive both the transport guide 43 and the pressing members 71. Thus, compared with a case where a drive source of a mechanism to press the first portion Sa of the sheets S and a drive source of a mechanism to press the second portion Sb of the sheets S are provided separately, downsizing and reduction in cost of the post-processing apparatus 3 can be achieved.

In this embodiment, the first portion Sa of the sheets S is a portion located upstream of the center portion of the sheets S in the sheet transport direction D. The second portion Sb of the sheets S is a portion located downstream of the center portion of the sheets S in the sheet transport direction D.

According to such a configuration, each of the front end and the rear end of the sheets S in the sheet transport direction D is pressed toward the processing tray 61. Thus, the sheets S are liable to be moved more stably from the standby tray 41 toward the processing tray 61.

In this embodiment, the interlocking unit 72 is coupled to the drive shaft 73*a* of the drive source 73. The interlocking unit 72 moves the transport guide 43 and the pressing members 71 toward the processing tray 61 along with the rotation of the drive shaft 73*a*.

According to such a configuration, both the movement of the transport guide 43 and the movement of the pressing members 71 are interlocked with the rotation of one drive shaft 73*a*. According to the interlocking unit 72 having the configuration as described above, it is possible to interlock the transport guide 43 and the pressing members 71 by a relatively simple configuration. As a result, the post-processing apparatus 3 can be further downsized.

In this embodiment, in the case where the sheets S enter the standby tray 41, the transport guide 43 is located above the standby tray 41. Further, in the case where the sheets S are moved from the standby tray 41 toward the processing tray 61, the transport guide 43 moves downward below the lower surface 45*a* of the standby tray 41.

According to such a configuration, in the case where the sheets S enter the standby tray 41, the transport guide 43 does not inhibit the entry of the sheets S. Additionally, in the case where the sheets S are moved from the standby tray 41 toward the processing tray 61, the transport guide 43 can press the sheets S downward below the lower surface 45*a* of the standby tray 41. Thus, the sheets S are reliably dropped below the standby tray 41 by the transport guide 43. If the sheets S are reliably dropped below the standby tray 41, it is possible to prevent the sheets S from being caught in the standby tray 41 in which the first tray member 46*a* and the second tray member 46*b* are opened in a mutually separating direction and then approaches each other to be closed again. As a result, the sheets S are liable to be moved more stably from the standby tray 41 toward the processing tray 61.

In this embodiment, in the case where the sheets S enter the standby tray 41, the pressing members 71 are located above the standby tray 41. Further, in the case where the sheets S are moved from the standby tray 41 toward the processing tray 61, the pressing members 71 protrude to substantially the same position as at least the lower surface 45*a* of the standby tray 41.

According to such a configuration, in the case where the sheets S enter the standby tray 41, the pressing members 71 do not inhibit the entry of the sheets S. Additionally, in the case where the sheets S are moved from the standby tray 41 toward the processing tray 61, the pressing members 71 can press the sheets S to substantially the same position as the lower surface 45*a* of the standby tray 41. Thus, the sheets S are reliably dropped below the standby tray 41 by the transport guide 43. If the sheets S are reliably dropped below the standby tray 41, it is possible to prevent the sheets S from being caught in the standby tray 41, which is opened and then closed again. As a result, the sheets S are liable to be moved more stably from the standby tray 41 toward the processing tray 61.

In this embodiment, the transport guide 43 includes the turning shaft 81 and the pressing portion 82. The turning shaft 81 is the center of turn of the transport guide 43.

The pressing portion 82 is located on the opposite side to the turning shaft 81 and comes into contact with the sheets S. The pressing members 71 protrude toward the processing tray 61 at positions between the turning shaft 81 and the pressing portion 82 of the transport guide 43 in the sheet transport direction D. According to such a configuration, even in the case where a relatively large member is adopted as the transport guide 43, the whole of the drop mechanism 70 including the transport guide 43 and the pressing members 71 can be relatively made small. As a result, the post-processing apparatus 3 can be further downsized.

From a different perspective, in this embodiment, the turning shaft 81 of the transport guide 43 is provided on the downstream side relative to the pressing members 71 in the sheet transport direction D. Further, the pressing portion 82 of the transport guide 43 is provided on the upstream side relative to the pressing members 71 in the sheet transport direction D.

According to such a configuration, a distance between the turning shaft 81 and the pressing portion 82 is relatively large. Thus, the transport guide 43 moves downward in a relatively gentle arc. Here, if the transport guide 43 moves downward in a relatively sharp arc, when the transport guide 43 comes into contact with the sheets S, force directed in the opposite direction to the stapler 62 may act on the sheets S. When the force directed in the opposite direction to the stapler 62 acts on the sheets S, the sheets S drop on the processing tray 61 while moving in a separating direction from the stapler 62. This makes it difficult to efficiently transport the sheets S, which have dropped on the processing tray 61, toward the stapler 62. Meanwhile, in this embodiment, the transport guide 43 moves downward in a relatively gentle arc. Thus, when the transport guide 43 comes into contact with the sheets S, the force directed in the opposite direction to the stapler 62 is difficult to act on the sheets S. Thus, it is possible to efficiently transport the sheets S, which have dropped on the processing tray 61, toward the stapler 62.

In this embodiment, in the case where the sheets S are moved from the standby tray 41 toward the processing tray 61, the pressing members 71 protrude downward below at least a part of the transport guide 43. According to such a configuration, it is possible to sufficiently press a portion of the sheets S, which cannot be sufficiently pressed by the transport guide 43, by the pressing members 71. As a result, the sheets S are liable to be moved more stably.

In this embodiment, in the case where the sheets S are moved from the standby tray 41 toward the processing tray 61, after the transport guide 43 comes into contact with the sheets S, the interlocking unit 72 synchronizes the transport guide 43 and the pressing members 71 with each other such that the pressing members 71 come into contact with the sheets S. According to such a configuration, the rear end of the sheets S can be started to drop earlier than the front end of the sheets S. Thus, the sheets S are liable to be moved more stably. Here, in this embodiment, the transport guide 43 and the pressing members 71 are mechanically synchronized with each other by the interlocking unit 72. Thus, a timing at which the transport guide 43 presses the first portion Sa of the sheets S and a timing at which pressing members 71 press the second portion Sb of the sheets S can be accurately adjusted. As a result, the sheets S are liable to be moved more stably.

(Second Embodiment)

Next, a post-processing apparatus 3 of a second embodiment will be described. This embodiment is different from the first embodiment in that each pressing member 71 and each drive member 91 are not cams but racks and pinion gears. It should be noted that the other configurations of this embodiment are similar to those of the first embodiment. Therefore, description of portions similar to the first embodiment will be omitted.

Figure 10:
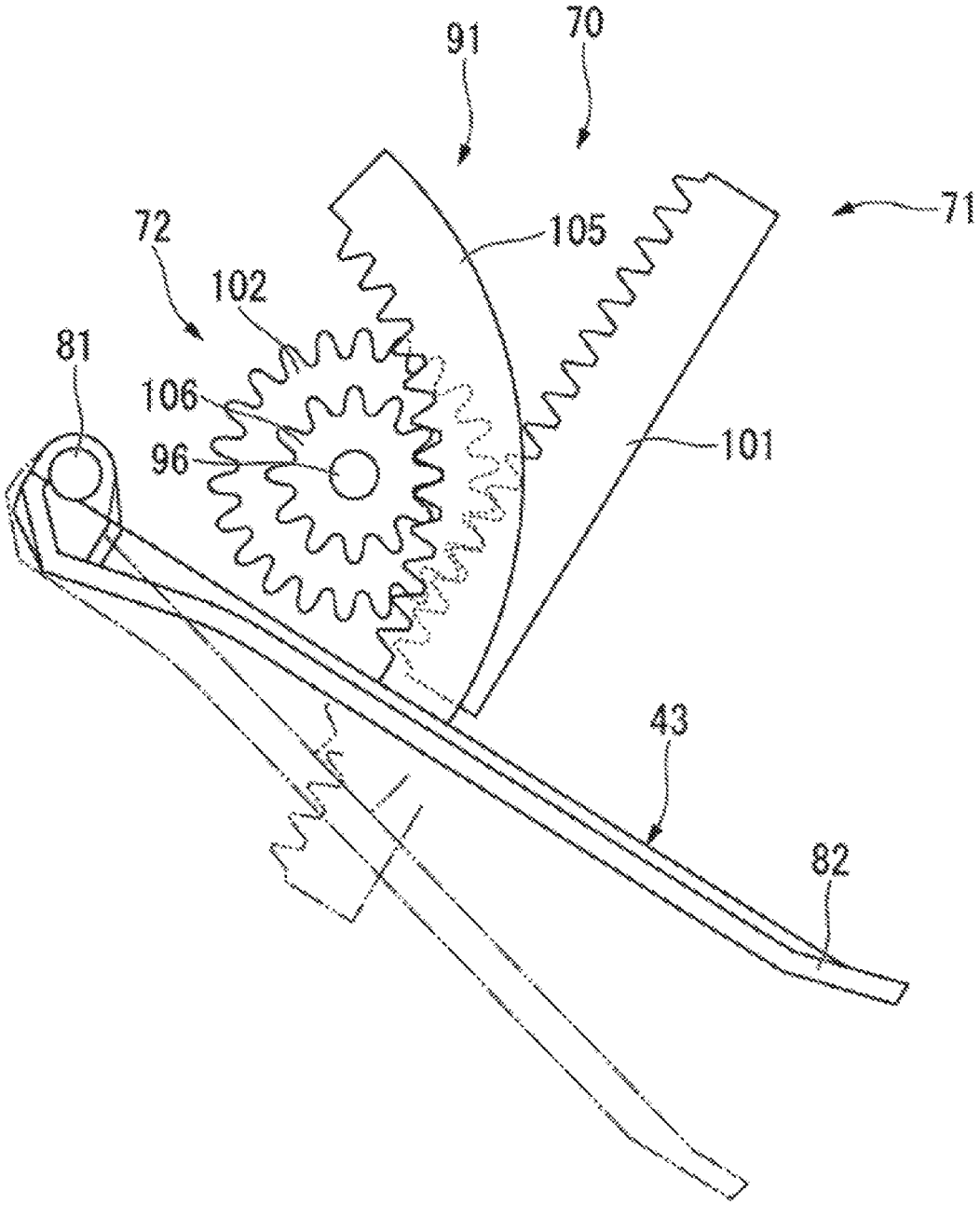
FIG. 10 is a cross-sectional view showing a part of a standby unit of a post-processing apparatus according to a second embodiment.

FIG. 10 shows a part of a pressing member 71 and an interlocking unit 72 of this embodiment. As shown in FIG. 10, the pressing member 71 of this embodiment includes a first rack 101 and a first pinion gear 102. The first rack 101 includes cogs on one surface thereof. The first rack 101 is supported to be movable toward the processing tray 61. The first pinion gear 102 is attached to a coupling shaft 96. The first pinion gear 102 is engaged with the first rack 101. When the coupling shaft 96 rotates, the first pinion gear 102 rotates. When the first pinion gear 102 rotates, the first rack 101 protrudes toward the processing tray 61.

Similarly, the drive member 91 of this embodiment includes a second rack 105 and a second pinion gear 106. The second rack 105 includes cogs on one surface thereof. The second rack 105 is attached to the transport guide 43. The second rack 105 is supported to be movable toward the processing tray 61. The second pinion gear 106 is attached to the coupling shaft 96. The second pinion gear 106 is engaged with the second rack 105. When the coupling shaft 96 rotates, the second pinion gear 106 rotates. When the second pinion gear 106 rotates, the second rack 105 moves the transport guide 43 toward the processing tray 61.

According to such a configuration, as in the first embodiment, the sheets S can be stably moved, and downsizing of the post-processing apparatus 3 can also be achieved.

(Third Embodiment)

Next, a post-processing apparatus 3 of a third embodiment will be described. This embodiment is different from the first embodiment in that each pressing member 71 has a corrugation function. It should be noted that the other configurations of this embodiment are similar to those of the first embodiment. Therefore, description of portions similar to the first embodiment will be omitted.

Figure 11:
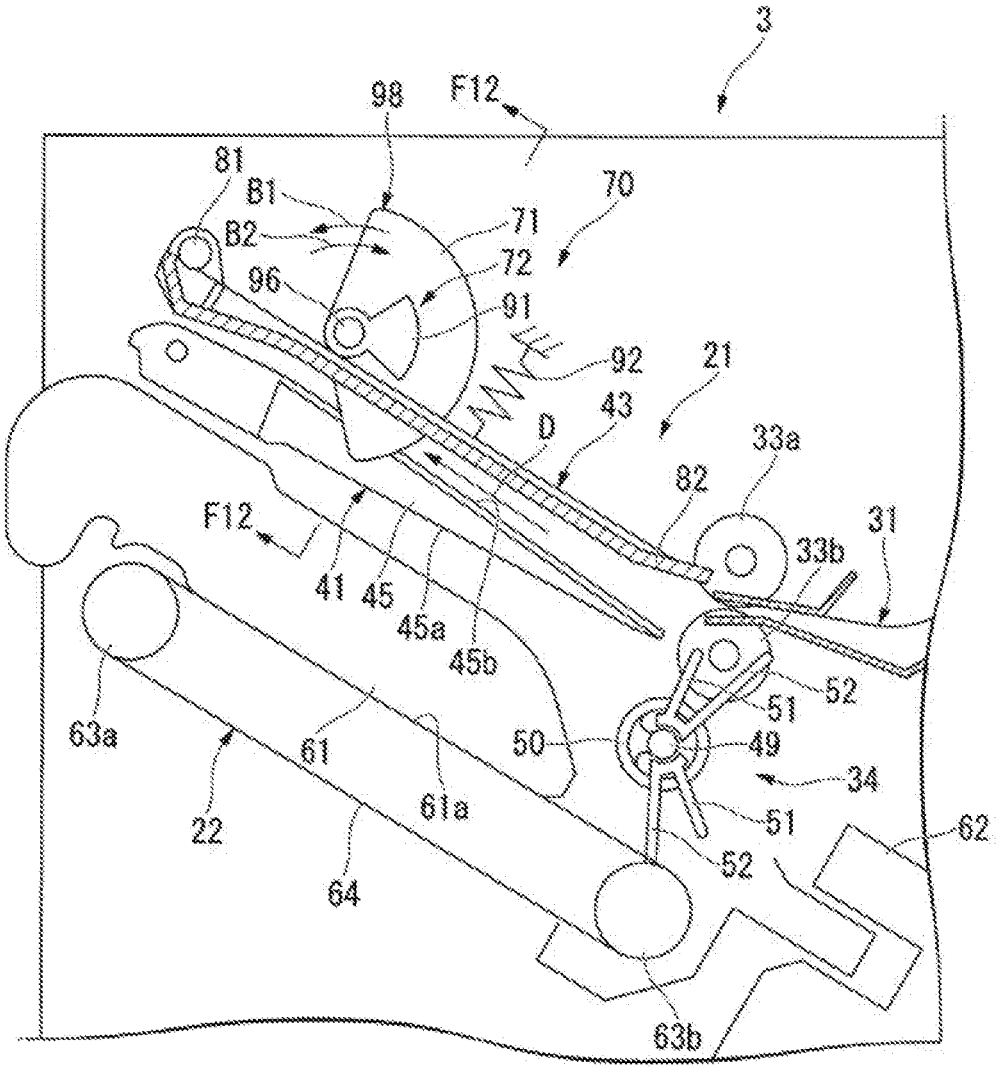
FIG. 11 is a cross-sectional view showing a standby unit of a post-processing apparatus according to a third embodiment.
Figure 12A:
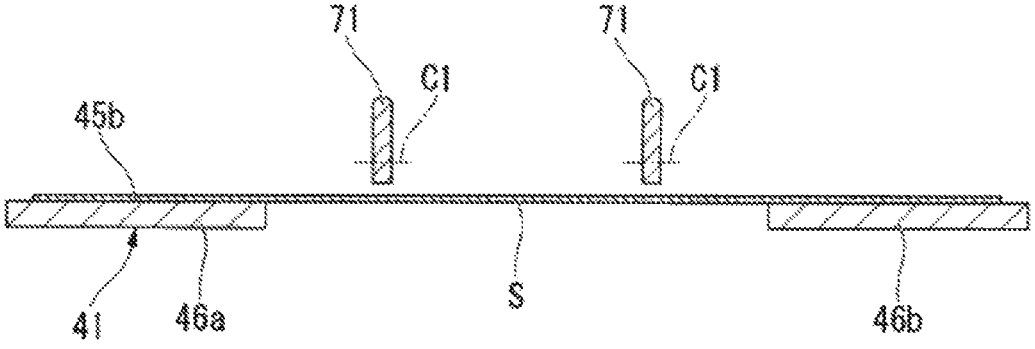
FIG. 12A is a cross-sectional view taken along the line F12-F12 of the standby unit shown in FIG. 11.
Figure 12B:
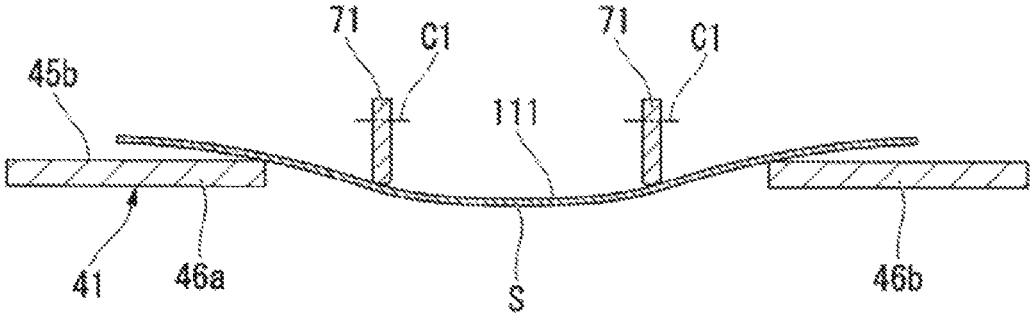
FIG. 12B is a cross-sectional view taken along the line F12-F12 of the standby unit shown in FIG. 11.

FIG. 11 shows an example of an operation of the pressing members 71 of this embodiment. FIGS. 12A and 12B are cross-sectional views taken along the line F12-F12 shown in FIG. 11. In this embodiment, for example, in the case where sheets S having a size larger than a predetermined size are supplied to a standby tray 41, the pressing members 71 protrude toward a processing tray 61.

Specifically, in the case where the pressing members 71 are rotated in the orientation of an arrow B1 in FIG. 11, the pressing members 71 protrude so as to press the sheets S toward the processing tray 61, as in the first embodiment. Similarly, in the case where drive members 91 are rotated in the orientation of the arrow B1 in FIG. 11, the drive members 91 move the transport guide 43 to the protruding position, as in the first embodiment.

Meanwhile, in the case where the pressing members 71 are rotated by a predetermined angle in the orientation of an arrow B2 in FIG. 11, the pressing members 71 protrude toward the processing tray 61. In the case where the drive members 91 are rotated by the predetermined angle in the orientation of the arrow B2 in FIG. 11, however, the drive members 91 do not contact with the transport guide 43. Thus, the transport guide 43 does not move downward. In other words, the drive members 91 of this embodiment are each formed into such a shape that does not come into contact with the transport guide 43 even when being rotated by the predetermined angle in the orientation of the arrow B2 in FIG. 11.

In the case where the pressing members 71 are rotated by the predetermined angle in the orientation of the arrow B2, the pressing members 71 protrude downward below an upper surface (transport surface) 45*b* of the standby tray 41 in a space between a pair of tray members 46*a* and 46*b*. In other words, the state of the pressing members 71 changes from a state shown in FIG. 12A to a state shown in FIG. 12B. When the pressing members 71 protrude downward below the upper surface 45*b* of the standby tray 41, as shown in FIG. 12B, the pressing members 71 can form a concave recess 111 at substantially the center portion of the sheets S. As a result, even if the sheets S have a size larger than a predetermined size, the sheets S are difficult to bend.

According to such a configuration, as in the first embodiment, the sheets S can be stably moved, and downsizing of the post-processing apparatus 3 can also be achieved. Additionally, according to this embodiment, the sheets S having a size larger than a predetermined size can be stably held.

(Fourth Embodiment)

Next, a post-processing apparatus 3 of a fourth embodiment will be described. This embodiment is different from the first embodiment in that a transport guide 43 and pressing members 71 are disposed in opposite positions to those of the first embodiment in a sheet transport direction D. It should be noted that the other configurations of this embodiment are similar to those of the first embodiment. Therefore, description of portions similar to the first embodiment will be omitted.

Figure 13:
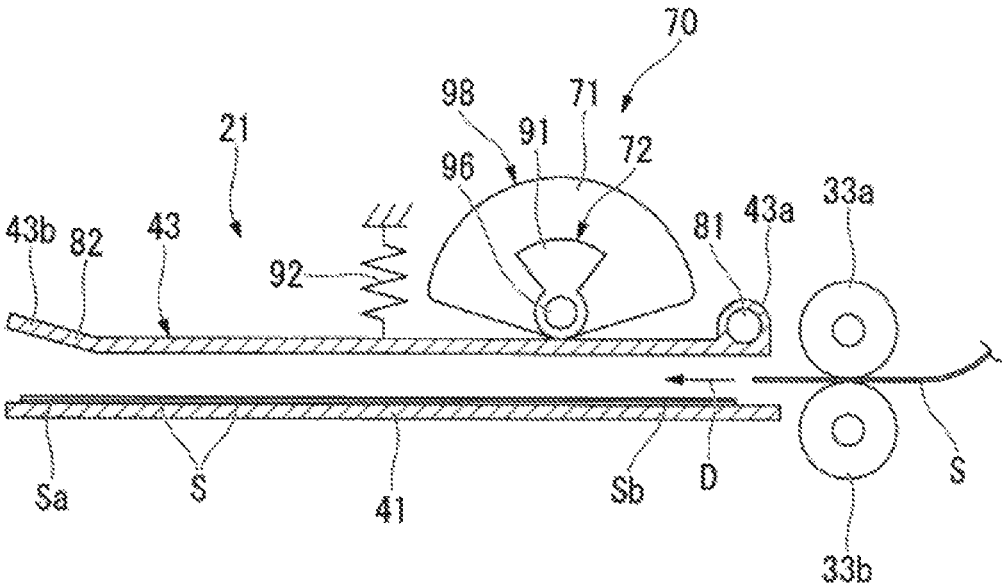
FIG. 13 is a cross-sectional view showing a standby unit of a post-processing apparatus according to a fourth embodiment.

FIG. 13 shows an arrangement of a transport guide 43, pressing members 71, and an interlocking unit 72 of this embodiment. As shown in FIG. 13, a turning shaft 81 of the transport guide 43 is disposed on the upstream side relative to a pressing portion 82 in the sheet transport direction D. The pressing members 71 and the interlocking unit 72 are also disposed on the upstream side relative to the pressing portion 82 of the transport guide 43.

In this embodiment, a first portion Sa of sheets S pressed by the transport guide 43 is disposed downstream of the center portion of the sheets S in the sheet transport direction D. A second portion Sb of the sheets S pressed by the pressing members 71 is located upstream of the center portion of the sheets S in the sheet transport direction D.

According to such a configuration, as in the first embodiment, the sheets S can be stably moved, and downsizing of the post-processing apparatus 3 can also be achieved. It should be noted that FIG. 13 shows an example of a standby tray 41 provided substantially parallel to a substantially horizontal direction. Instead of this, the standby tray 41 may be tilted with respect to the horizontal direction, as in the first embodiment.

The configurations according to the first to fourth embodiments have been described, but the configurations of the respective embodiments are not limited to the examples described above. Those configurations can be combined for applications.

Further, the configurations according to the embodiments are not limited to the examples described above. For example, an example of the sheet processing apparatus may be an image-forming apparatus including an inner finisher within a casing.

According to at least one of the embodiments described above, the post-processing apparatus 3 includes the standby tray 41, the processing tray 61, the transport guide 43, the pressing members 71, and the interlocking unit 72. The processing tray 61 is provided below the standby tray 41. The transport guide 43 can press the first portion Sa of the sheets S in accordance with the movement of the sheets S. In other words, in the case where the sheets S are moved from the standby tray 41 toward the processing tray 61, the transport guide 43 comes into contact with the first portion Sa of the sheets S and presses the first portion Sa of the sheets S toward the processing tray 61. The pressing members can press the second portion Sb of the sheets S, the second portion Sb being located downstream of the first portion Sa of the sheets S. In other words, in the case where the sheets S are moved from the standby tray 41 toward the processing tray 61, the pressing members 71 come into contact with the second portion Sb of the sheets S and press the second portion Sb of the sheets S toward the processing tray 61. The interlocking unit 72 interlocks the above-mentioned pressing operation of the transport guide 43 and the operation of the pressing members 71. As a result, the sheets S can be stably moved, and downsizing of the post-processing apparatus 3 can also be achieved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a first tray that holds a sheet transported to the sheet processing apparatus in a sheet transport direction;

a second tray that is provided below the first tray and holds the sheet moved from the first tray;

a first member located above the first tray when the sheet is transported to the first tray, the first member being rotatable about a turning shaft and including a pressing portion that is located at an end opposite to the turning shaft, the first member being configured to:

press a first portion of the sheet toward the second tray when the sheet is moved from the first tray to the second tray, and when the sheet is moved from the first tray to the second tray, rotate so that the pressing portion moves downward below a lower surface of the first tray and comes into contact with a first portion of the sheet;

a second member located downstream in the sheet transport direction of the first portion of the sheet held in the first tray and protruding toward the second tray at a position between the turning shaft and the pressing portion of the first member, the second member being configured to:

be positioned above the first tray when the sheet is transported to the first tray, and move from above the first tray to a position in which a portion of the second member protrudes at least substantially at the same position as or below the lower surface of the first tray, and press a second portion of the sheet toward the second tray, when the sheet is moved from the first tray to the second tray; and an interlocking unit that interlocks a pressing operation of the first member and a pressing operation of the second member.

2. The sheet processing apparatus according to claim 1, wherein the first portion of the sheet that the pressing portion contacts is on an upstream side of a center portion of the sheet in the sheet transport direction, and the second portion of the sheet that the second member presses is on a downstream side of the center portion of the sheet in the sheet transport direction.

3. The sheet processing apparatus according to claim 1, further comprising:

a drive source; and a drive shaft of the drive source, wherein the interlocking unit is coupled to the drive shaft, and moves the first member and the second member toward the second tray along with rotation of the drive shaft.

4. The sheet processing apparatus according to claim 1, wherein the turning shaft of the first member is provided on a downstream side relative to the second member in the sheet transport direction, and the pressing portion of the first member is provided on an upstream side relative to the second member in the sheet transport direction.

5. The sheet processing apparatus according to claim 1, wherein the second member protrudes downward below at least a part of the first member, when the sheet is moved from the first tray to the second tray.

6. The sheet processing apparatus according to claim 1, wherein the interlocking unit synchronizes a movement of the first member and a movement of the second member such that the second member comes into contact with the sheet after the first member comes into contact with the sheet, when the sheet is moved from the first tray to the second tray.

7. The sheet processing apparatus according to claim 1, wherein the first member is a transport guide that guides the transported sheet to the first tray when the sheet is transported to the first tray.

8. The sheet processing apparatus according to claim 1, wherein the second member is a pressing member that presses the sheet to form a recess, when the sheet transported to the first tray has a size larger than a predetermined size.

* * * * *